US012780362B2

(12) United States Patent
Ricard et al.

(10) Patent No.: US 12,780,362 B2
(45) Date of Patent: Nov. 3, 2026

(54) TOWED SUBMARINE DEVICE

(71) Applicant: THALES, Meudon (FR)

(72) Inventors: Michel Ricard, Sophia Antipolis (FR); Philippe Lanoe, Brest (FR)

(73) Assignee: THALES, Meudon (FR)

( * ) Notice: Subject to any disclaimer, the term of this patent is extended or adjusted under 35 U.S.C. 154(b) by 141 days.

(21) Appl. No.: 18/847,650

(22) PCT Filed: Apr. 21, 2023

(86) PCT No.: PCT/EP2023/060407
§ 371 (c)(1),
(2) Date: Sep. 16, 2024

(87) PCT Pub. No.: WO2023/222327
PCT Pub. Date: Nov. 23, 2023

(65) Prior Publication Data

US 2025/0360986 A1 Nov. 27, 2025

(30) Foreign Application Priority Data

May 19, 2022 (FR) ..... 2204765

(51) Int. Cl.
*B63B 21/16* (2006.01)
*B63B 21/66* (2006.01)
*B63B 27/16* (2006.01)

(52) U.S. Cl.
CPC ..... *B63B 21/16* (2013.01); *B63B 21/663* (2013.01); *B63B 27/16* (2013.01)

(58) Field of Classification Search
CPC ..... B63B 21/16; B63B 21/663; B63B 27/16; B63B 2027/165
See application file for complete search history.

(56) References Cited

U.S. PATENT DOCUMENTS 3,493,074 A 2/1970 Murray
9,981,718 B2 * 5/2018 Ricard ..... B63B 21/66

FOREIGN PATENT DOCUMENTS

WO 2018/065385 A1 4/2018
WO 2021/069640 A1 4/2021

* cited by examiner

*Primary Examiner* — Michael L Sehn
(74) *Attorney, Agent, or Firm* — BakerHostetler

(57) ABSTRACT

An underwater device intended to be towed by a surface ship, the surface ship being capable of including a handling system for stowing and deploying the underwater device. The handling system includes a tow cable and an attachment cable. The underwater device includes a flexible elongate body and a towed body, the towed body being capable of being arranged between the tow cable and the flexible elongate body. The underwater device also includes an intermediate element capable of being arranged between the towed body and the flexible elongate body. The intermediate element is connected to the towed body by a first connection. The intermediate element is connected to the flexible elongate body by a second connection, the first connection being an articulated mechanical connection. The intermediate element is a cable of low stiffness. The underwater device includes a recovery cord.

9 Claims, 13 Drawing Sheets

TOWED SUBMARINE DEVICE

CROSS-REFERENCE TO RELATED APPLICATIONS

This application is a National Stage of International patent application PCT/EP2023/060407, filed on Apr. 21, 2023, which claims priority to foreign French patent application No. FR 2204765, filed on May 19, 2022, the disclosures of which are incorporated by reference in their entireties.

FIELD OF THE INVENTION

The present invention relates to an underwater device intended to be towed by a surface ship comprising a handling system capable of being installed on the surface ship and configured to stow and deploy said underwater device. The invention can be used particularly in the field of underwater devices of the active sonar type comprising a cable which tows a towed body incorporating a transmission array. The towed body is sometimes referred to as "towfish" on account of its shape. A linear reception array forming a flexible elongate body is towed behind the towfish. Reference is then made to a dependent towing system. The linear reception array is sometimes referred to as "streamer", likewise on account of its shape. The towed body may be a body of volume suspended from the tow cable or may be of elongate shape along a longitudinal axis and incorporate a linear transmission array comprising transducers distributed along the longitudinal axis.

BACKGROUND

The handling of such underwater devices is tricky. More specifically, outside of periods of use, the underwater device is stowed on a deck of the surface ship, generally a stern deck. The launch and recovery of the underwater device requires operators to be present on the stern deck of the surface ship. The operators have to handle heavy loads, and this may be dangerous, particularly in a developed sea.

The tow cable for towing the towed body is referred to as "heavy cable", since it has a high weight in order to make the coupling sink. This tow cable generally comprises a core formed of electrical and/or optical conductors for transmitting power and information between sonar instruments onboard the ship and the arrays. The cable core is generally covered with a strand of metal wires that give the cable its mechanical strength. The towed body is generally massive. It may be fitted with rudders to provide its hydrodynamic stability. The linear reception array may extend over a length of around a hundred meters in order to detect soundwaves propagating through the water at low frequency. They may be echoes of soundwaves emitted by the transmission array when the sonar is operating in active mode. The sonar may also operate in passive mode without the emission of soundwaves.

In patent application WO 2018/065385 A1 filed in the name of the Applicant Company, a single winch allows the tow cable and the reception array to be handled. They have neutral buoyancy and this cable is referred to as "light cable". The tow cable and the reception array are secured to one another. Upon launch, the towed body is attached and connected at the junction between the tow cable and the reception array to the light cable of the reception array, or even directly to the reception array. The aim of the light cable is to move the array away from the towing ship's own noise. The flexible elongate body then surrounds the light cable and the reception array. Such an arrangement of the tow cable and the reception array on one and the same winch does present certain problems. In particular, the winch needs to be suitable for the greatest radius of curvature permitted by the tow cable and the reception array. This can lead to the drum of the winch being significantly oversized. In addition, it may be beneficial to handle the tow cable and the reception array separately, something that the single winch is unable to permit, by contrast to an assembly comprising two winches/drums, which is to say one winch for the heavy cable and one winch for the flexible elongate body.

In another patent application, WO2021069640, filed in the name of the Applicant Company, two separate winches are used, one for the tow cable and the other for the reception array. A rigid and movable arm is positioned between the towed body and the flexible elongate body. Upon recovery of the towed body, the rigid arm is not always positioned correctly and the connection between the rigid arm and the flexible elongate body must not have any bending, so as to not run the risk of damaging the reception array. Such a risk of bending can come about when the towed body is not stowed away quite as expected when it is being recovered from the sea. Moreover, the stiffness of the device, its eccentric weight, increased by potentially shipped seawater upon launch or recovery could induce stresses which result in risks of breakage.

SUMMARY OF THE INVENTION

An object of the invention is to facilitate maneuvers for launching and recovery of the various elements of the towed underwater device while still ensuring the operator is quite safe during the handling operations.

To this end, the invention proposes an underwater device intended to be towed by a surface ship, said surface ship being capable of comprising a handling system for stowing and deploying the underwater device. The handling system comprises a tow cable and an attachment cable. Said underwater device comprises:

- a flexible elongate body;
- a towed body, said towed body being capable of being arranged between the tow cable and said flexible elongate body;
- an intermediate element capable of being arranged between the towed body and the flexible elongate body, said intermediate element being connected to the towed body by a first connection, said intermediate element being connected to the flexible elongate body by a second connection, said first connection being an articulated mechanical connection. The intermediate element is a low-stiffness cable. The underwater device comprises a recovery cord connected to the flexible elongate body, said recovery cord comprising a downstream shackle at an end opposite the flexible elongate body, said downstream shackle allowing the recovery cord to be fixed either to the tow cable via the towed body or to the attachment cable coming from the winch of the flexible elongate body.

The low-stiffness cable means the operator does not need to lean too far behind the towfish to perform the attachment. In the prior art, the intermediate element is a rigid articulated arm which imposes a given distance between the two winches. Moreover, the articulated arm prevents the towed body from being placed at the edge of the stern if the doors are provided at the rear of the boat. The low-stiffness cable allows this distance to be drastically reduced and allows the doors to be kept closed and thus operator safety to be improved. Moreover, using a cable of low stiffness eliminates the positioning constraint between the two winches and makes the connecting operations easier/safer for the operator. In addition, the use of a recovery cord makes it easier to subsequently recover the junction between the flexible elongate body and the intermediate element.

"Cable" is understood to mean a protected conductive metal wire. In this case, the cable is an electro-optical tow cable.

A "low-stiffness cable" is understood to mean a cable having a stiffness k less than 10 N/m.

"Line" is understood to mean a combination of strands twisted together. These strands may be made of a textile material, Kevlar, steel or the like.

"Shackle" is understood to mean a metal buckle having a rapid and secure closure system.

In a particular embodiment, the attachment cable comprises an upstream shackle designed to be attached to the downstream shackle of the recovery cord.

In a particular embodiment, the intermediate element is a cable from light cable technology.

In a particular embodiment, the intermediate element comprises an electro-optical strand and a plurality of force reacting strands, said strands being separate.

In a particular embodiment, the intermediate element is a reinforced cable.

In a particular embodiment, the cable is reinforced by a tension braid.

It is thus possible to keep the tension while still making use of a low-stiffness cable.

In a particular embodiment, the handling system comprises two winches, a first winch being capable of stowing and deploying the tow cable, a second winch being capable of stowing and deploying the attachment cable. In a first position, the intermediate element is aligned with the flexible elongate body to allow the first winch to tow the entire underwater device. In a second position, the intermediate element is unaligned with respect to the flexible elongate body to allow the flexible elongate body to be aligned with the second winch.

In a particular embodiment, the underwater device comprises an electrical and/or optical link between the towed body and the flexible elongate body. This electrical and/or optical link can be disconnected.

Another subject of the invention relates to a method for launching an underwater device using a handling system which is part of a surface ship. The handling system comprises a tow cable and an attachment cable. The underwater device comprises:

- a flexible elongate body;
- a towed body, said towed body being capable of being arranged between the tow cable and said flexible elongate body during use of the underwater device;
- an intermediate element capable of being arranged between the towed body and the flexible elongate body, said intermediate element being connected to the towed body by a first connection, said intermediate element being connected to the flexible elongate body by a second connection, said first connection being an articulated mechanical connection, said second connection being disconnectable, said intermediate element being a low-stiffness cable and the underwater device comprising a recovery cord connected to the flexible elongate body, said recovery cord comprising a downstream shackle at an end opposite the flexible elongate body, said downstream shackle allowing the recovery cord to be fixed either to the tow cable via the towed body or to the attachment cable.

The handling system comprises two winches, a first winch for stowing and deploying the tow cable, a second winch for stowing and deploying the attachment cable. In a first position, the intermediate element is aligned with the flexible elongate body to allow the first winch to tow the entire underwater device. In a second position, the intermediate element is unaligned with respect to the flexible elongate body to allow the flexible elongate body to be aligned with the second winch. The launching method comprises:

- a step of paying out the second winch to launch the flexible elongate body, the recovery cord being taut;
- a step of connecting the flexible elongate body to the second end of the intermediate element in the unaligned position;
- a step of positioning the intermediate element in alignment;
- a step of paying out the second winch to slacken the recovery cord, the tension being reacted by the intermediate element;
- a step of attaching the downstream shackle to the towed body and a step of detaching said downstream shackle from the attachment cable, so as to allow subsequent recovery of a junction between the flexible elongate body and the intermediate element;
- a step of paying out the first winch.

BRIEF DESCRIPTION OF THE DRAWINGS

The invention will be better understood and further advantages will emerge on reading the detailed description of an embodiment which is given by way of example, this description being illustrated by the appended drawing in which.

For the sake of clarity, identical elements bear the same references in the various figures.

DETAILED DESCRIPTION

The invention is described in relation to the towing of an active sonar by a surface ship. Of course, the invention can be implemented for any type of towed underwater devices.

Figure 8:
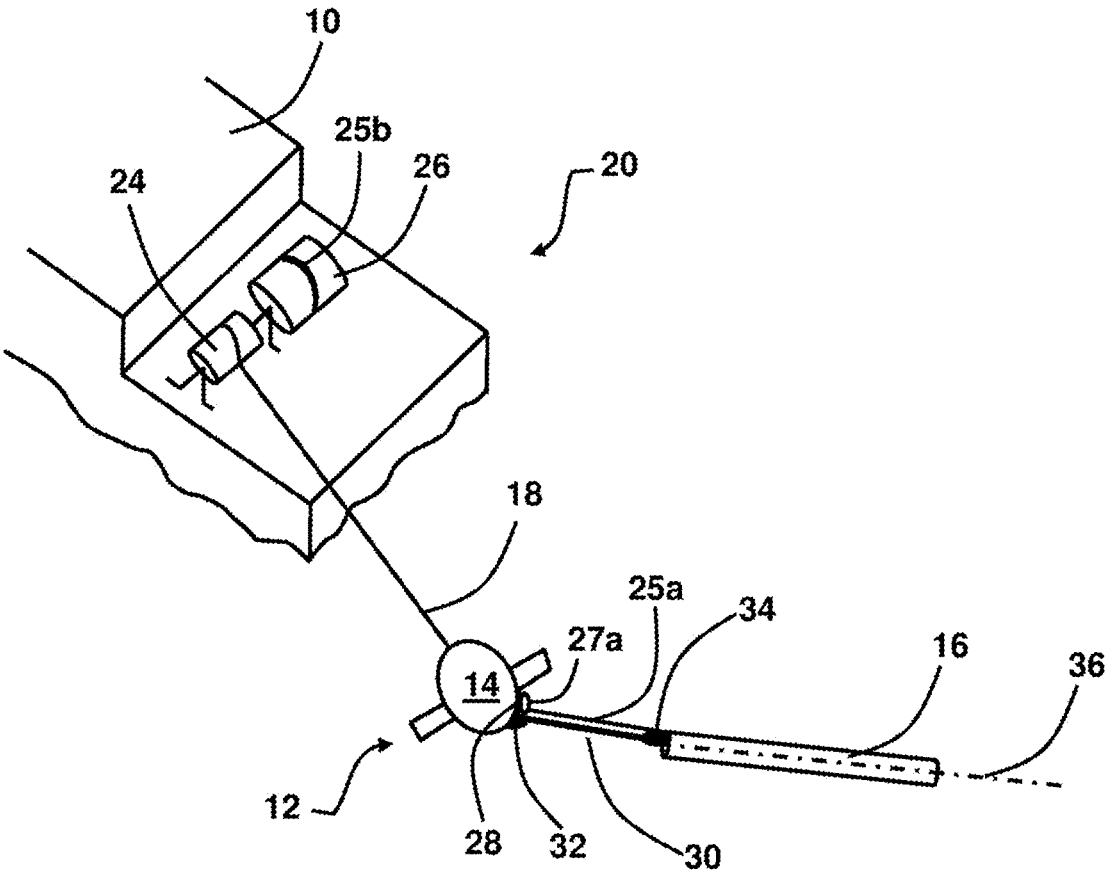
FIG. 8 shows the underwater device from FIG. 1 in an eighth step of the method for launching it.

FIG. 8 shows a ship 10 towing an active sonar 12 comprising a towed body 14 incorporating an acoustic transmission array and a flexible elongate body 16 forming an acoustic reception array. In the following text, the towed body will be referred to as a towfish 14 and the flexible elongate body will be referred to as a streamer 16. The sonar 12 also comprises a cable 18 for towing the towfish 14 and the streamer 16. The cable 18 also carries signals and power between the ship 10, the towfish 14 and the streamer 16.

The towfish 14 and the streamer 16 are mechanically anchored and electrically and/or optically connected to the cable 18 in a suitable way. Conventionally, the streamer 16 is formed of a linear array of tubular shape identical to those found in passive sonars, hence its name streamer, while the transmission array is incorporated in a structure of volume forming the towed body 14 and having a shape like that of a fish. The streamer 16 is anchored to the towfish 14 which is itself anchored to the end of the cable 18. During an underwater acoustic mission in active mode, the array of the towfish 14 transmits soundwaves into the water and the reception array of the streamer 16 picks up any echoes bouncing off targets on which the soundwaves originating from the transmission array are reflected.

Figure 5:
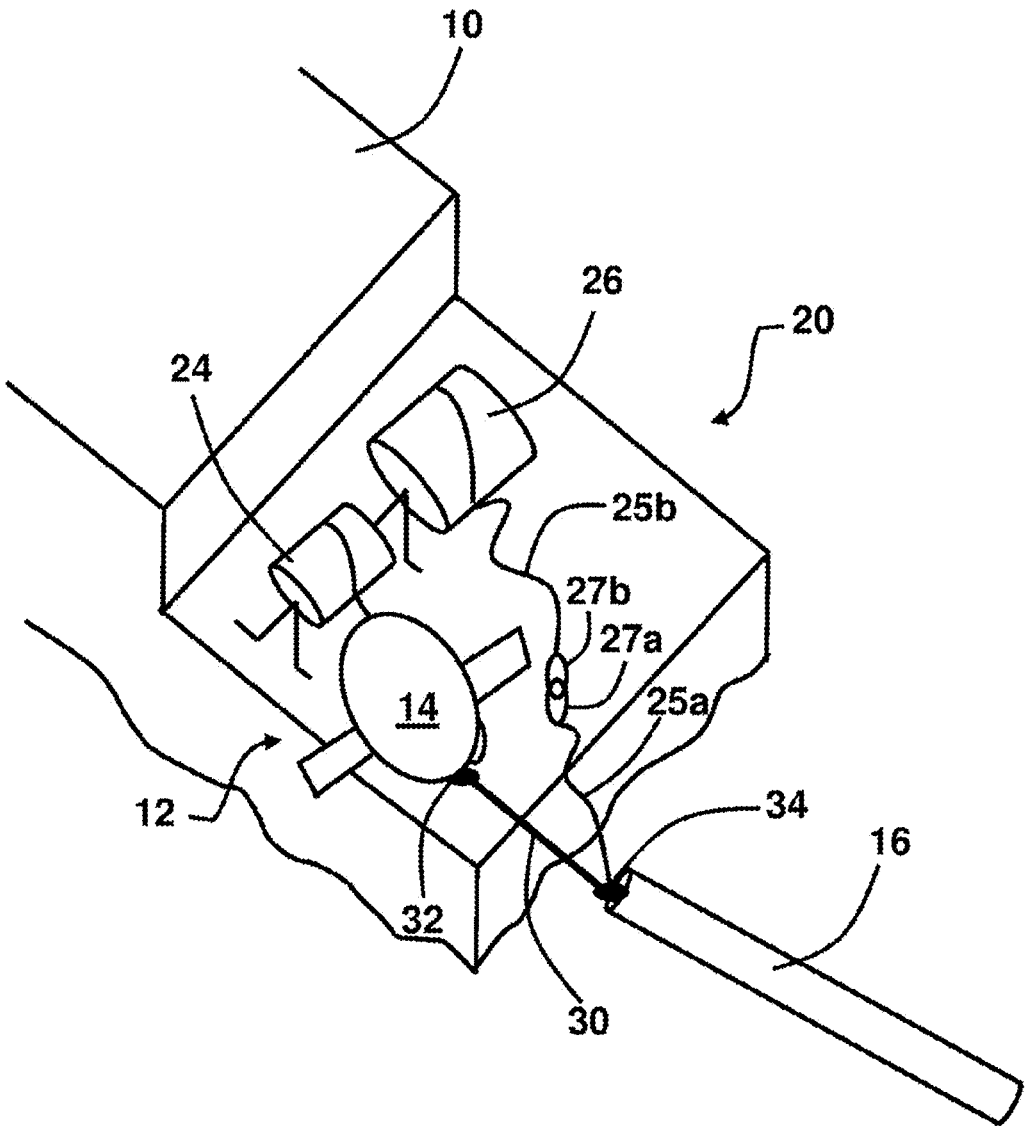
FIG. 5 shows the underwater device from FIG. 1 in a fifth step of the method for launching it.

A handling device 20 is disposed on a stern deck 22 of the ship 10. The handling device 20 comprises two winches 24 and 26. The winch 24 allows the tow cable 18 and the towfish 14 to be stowed and deployed. The winch 26 allows the streamer 16 to be stowed and deployed. When the active sonar 12 is in the deployed position, as depicted in FIG. 5, only the winch 24 is in operation. The winch 24 tows the entire sonar 12. More specifically, the cable 18 tows the towfish 14 and the streamer 16 is attached behind the towfish 14.

In FIG. 8, the winch 24 is situated on the port side of the ship 10 and the winch 26 on the starboard side. Other configurations are also possible, with the winch 24 on the starboard side and the winch 26 on the port side, the winch 24 being above or below the winch 26. More generally, the two winches 24 and 26 are offset relative to one another.

The sonar 12 comprises an intermediate element 30. This intermediate element 30 is disposed between the towfish 14 and the streamer 16. More particularly, the intermediate element 30 is connected to the towfish 14 by a first connection 32. In addition, the intermediate element 30 is connected to the streamer 16 by a second connection 34. The first connection 32 is an articulated mechanical connection. It may also be dismounted to replace the intermediate element for maintenance operations. This first connection 32 is shown as fixed in this case. In a variant, this first connection 32 may be disconnected. The second connection 34 can be disconnected in this case. In FIG. 8, when the active sonar 12 is in the deployed position, the intermediate element 30 is aligned with the streamer 16. More specifically, the intermediate element 30 and the streamer 16 both extend substantially along the same axis 36. When the ship 10 is sailing in a straight line, the axis 36 is substantially parallel to the line of travel of the ship. In practice, the forces of drag experienced by the streamer 16 orient the intermediate element 30 and the streamer 16 naturally in the water along the axis 36 which may fluctuate notably according to the weather conditions, more particularly according to the swell conditions which cause the towing ship to pitch and roll.

The towfish 14 and the streamer 16 are also connected to one another by a recovery cord 25*a*. More particularly, the recovery cord 25*a* comprises a downstream shackle 27*a* attached to a coupling means 28 which is part of the towfish 14. The other end of the recovery cord 25*a* is in this case connected to the streamer 26 via the second connection 34.

Figure 2:
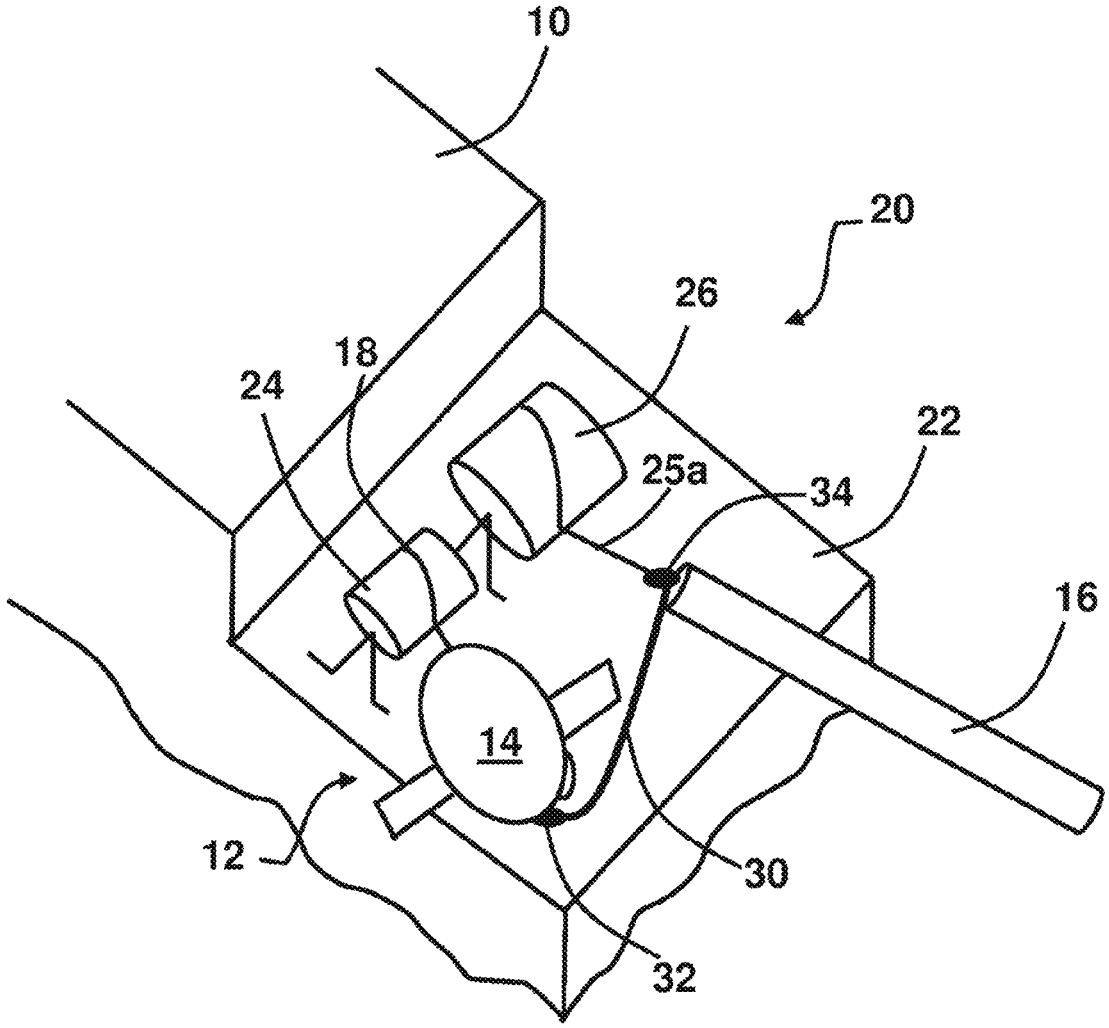
FIG. 2 shows the underwater device from FIG. 1 in a second step of the method for launching it.

FIG. 2 shows the ship from FIG. 8 of which the sonar 12 is in the course of being launched or brought back up. More specifically, the towfish 14 is placed on the deck 22, possibly in a cradle designed to hold it. The winch 24 is stationary. The cable 18 is almost completely hauled in on the winch 24. The intermediate element 30 is unaligned with respect to the streamer 16, allowing the streamer 16 to be aligned with the winch 26.

Figure 9:
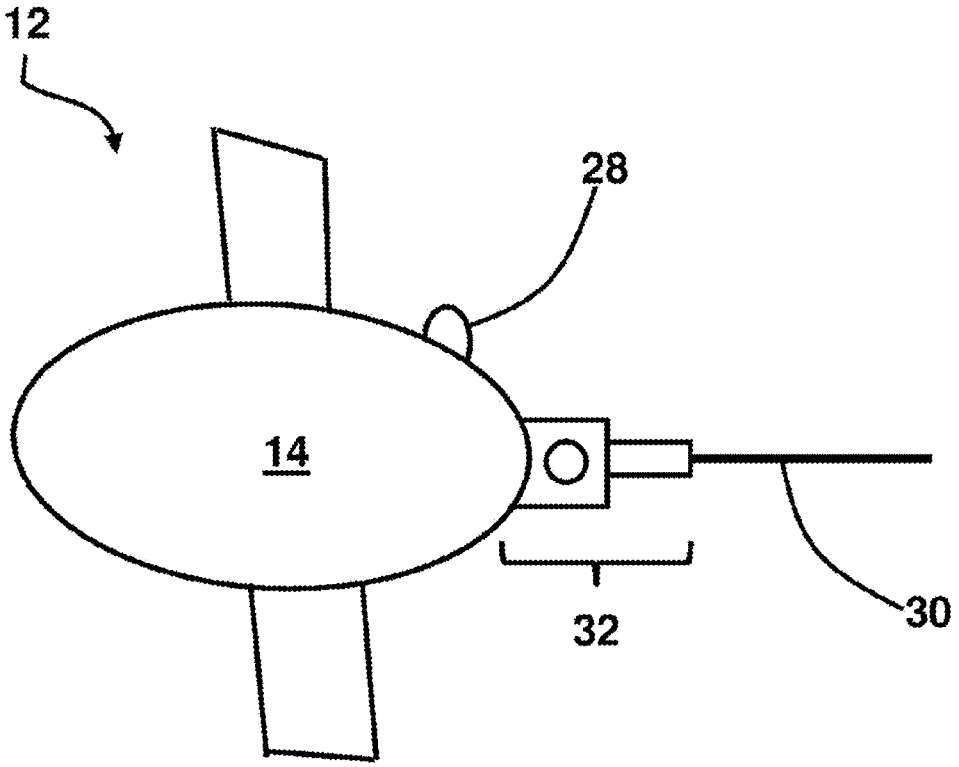
FIG. 9 is an enlarged view of the towed body of the underwater device from FIGS. 1 to 8, in a first configuration of a connection.

To ensure good alignment between the intermediate element 30 and the streamer 16, at the end 32, the articulation between the towfish 14 and the intermediate element 30 is advantageously of the pinned ball joint, or ball joint type, which is to say having at least two degrees of freedom in rotation about axes perpendicular to the axis 36. Such an articulation is disclosed in particular in FIGS. 8 and 9. Likewise, at the end 34, the articulation between the intermediate element 30 and the streamer 16 advantageously has at least one degree of freedom in rotation about an axis that allows the streamer 16 to be aligned with the winch 26. The streamer 16 advantageously maintains a degree of freedom in rotation about the axis 36. This degree of freedom may be provided either at the end 32 by means of a ball joint connection or at the end 34 by means of a pinned ball joint connection. It is also possible for this degree of freedom to be situated both at the end 32 and at the end 34, thereby making it easier to align the streamer 16 with the winch 26. In a variant, it is possible to not provide a ball joint at the end 32. In this case, the intermediate element 30 starts directly from the towfish. In the same way, it is possible to not provide a ball joint at the end 34.

The presence of the intermediate element 30 allows the operator tasked with coupling the streamer 16 to the towfish 14 not to have to take up a position behind the towfish 14 in order to perform the coupling, thereby making this coupling operation easier. This coupling can be done at the base of the winch 26, which is to say in a location far away from the stern end of the surface ship 10. The operator can then face toward the sea so as to be able to see any occurrence of an oversized wave and take shelter as a result.

The intermediate element 30 is in this case a flexible cable.

Figure 11:
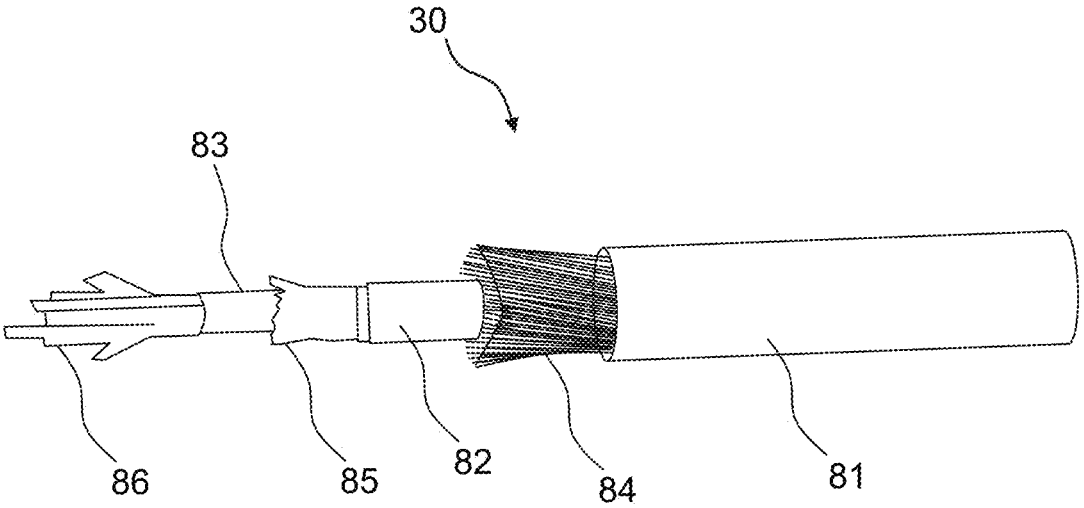
FIG. 11 schematically shows an intermediate element of the underwater device from FIGS. 1 to 8 according to a first embodiment.

In a first embodiment shown in FIG. 11, the intermediate element 30 is a cable compatible with LTC (for "light tow cable") technology. In the embodiment in FIG. 8, this cable comprises:

- a cable outer cover 81;
- an electro-optical core outer cover 82;
- an electro-optical core inner cover 83;
- a fabric 84;
- an electrical shield 85;
- an electro-optical core 86.

The cable outer cover 81 is designed to protect the light cable. It thus ensures water-tightness. It is made of a nylon material of the PA12 type.

The outer cover 82 and the inner cover 83 give the element 30 an intermediate stiffness. These covers 82, 83 are made of a rubbery material of the silicone and/or PE type.

The fabric 84 is placed between the cable outer cover 81 and the electro-optical core outer cover 82. It allows reaction of force. This fabric 84 is made of a material of the Kevlar type.

The electrical shield 85 is placed between the cable outer cover 82 and the inner cover 83.

The electro-optical core 86 comprises electrical wires and fibers. It allows remote transmission from the reception array, which is to say remote powder supply of the array and transmission of the reception signals.

Figure 12:
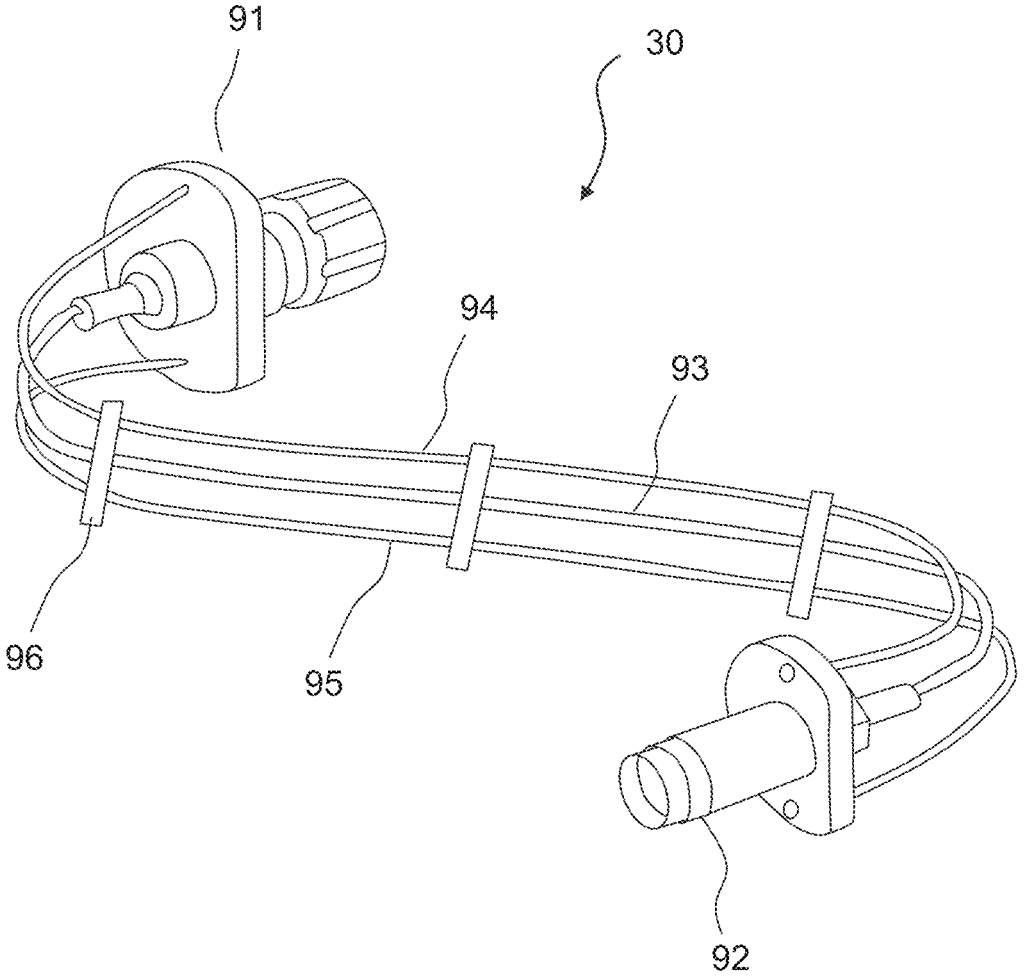
FIG. 12 schematically shows an intermediate element of the underwater device from FIGS. 1 to 8 according to a second embodiment.

In a second embodiment shown in FIG. 12, the intermediate element 30 is a cable compatible with TANDEM technology.

This cable 30 in this case comprises:

a first connecting means 91;

a second connecting means 92;

a transmission line 93;

a first force reacting line 94;

a second force reacting line 95;

linking means 96.

The first connection means 91 and the second connection means 92 allow the intermediate element 30 to be connected to both the towfish 14 and the streamer 16. The transmission line 93 allows information to be transmitted between the first connection means 91 and the second connection means 92. This transmission line 93 is an electro-optical core. The first force reacting line 94 and the second force reacting line 95 provide an overall sturdiness of the intermediate element 30, thereby enabling both a tensile strength and a low stiffness that make it easier for an operator to handle the intermediate element. The linking means 96 allow the transmission line 93 to be connected to the force reacting lines 94, 95. In the embodiment in FIG. 9, the transmission line 93 and the force reacting lines 94, 95 are separate and parallel. However, the transmission line 93 is less taut overall than the force reacting lines 94, 95.

FIG. 12 shows, by way of example, two force reacting lines 94, 95. Of course, the number of force reacting lines may be different than 2. This number is thus between 1 and N force reacting lines, where N is an integer greater than or equal to 2.

Figure 10:
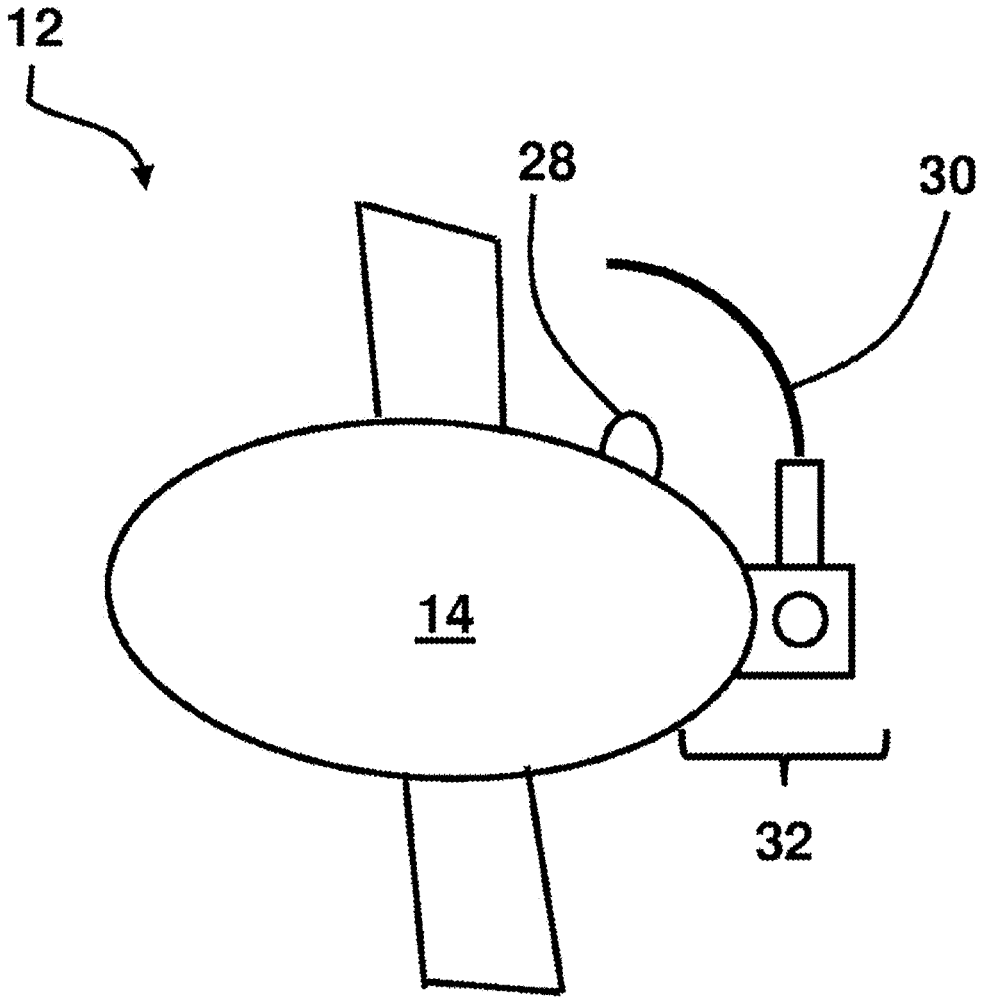
FIG. 10 is an enlarged view of the towed body of the underwater device from FIGS. 1 to 8, in a second configuration of the connection from FIG. 9.
Figure 13:
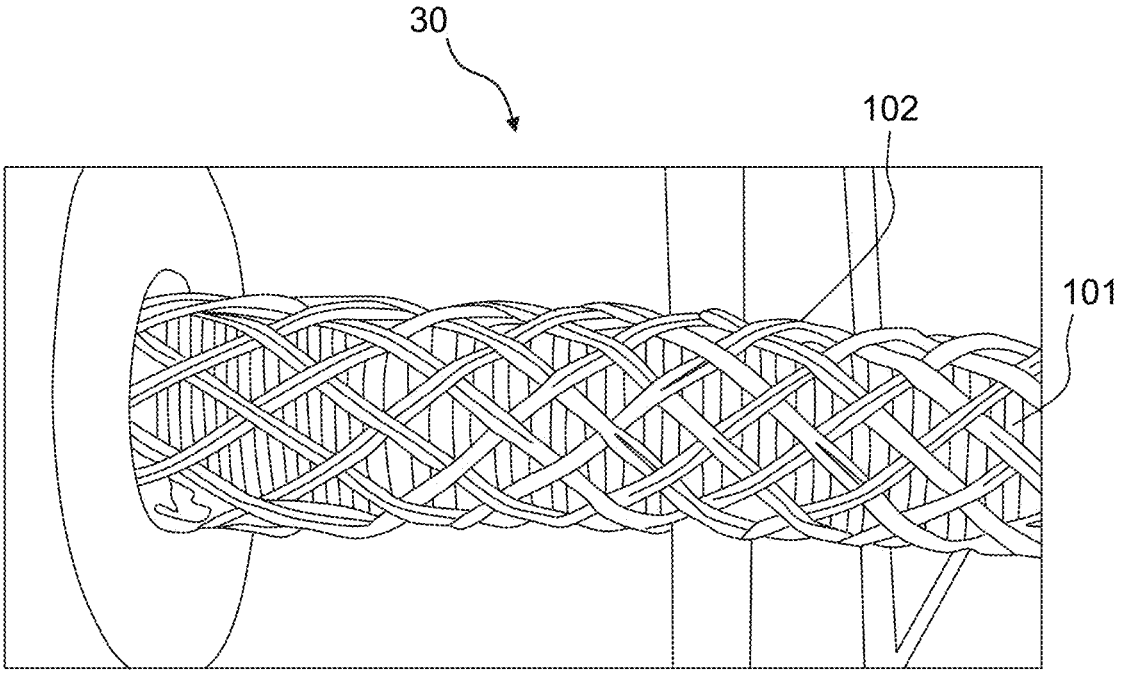
FIG. 13 schematically shows an intermediate element of the underwater device from FIGS. 1 to 8 according to a third embodiment.

In a third embodiment shown in FIG. 13, the intermediate element 30 is a cable compatible with HTC JB LINK technology, in which the electro-optical core is reinforced and flexible. More particularly, in FIG. 10, the cable comprises:

a sheath 101;

a tension braid 102.

The sheath 101 is designed to surround and protect an information transmission line. It is a helical spring made of rust-proof metal. This spring protects the electro-optical core, which is inside it. The tension braid 102 gives the assembly a certain sturdiness. It is made up of a self-tightening mesh of the "Chinese finger" type.

FIGS. 1 to 8 describe the various steps of a method for launching the underwater device 12.

Figure 1:
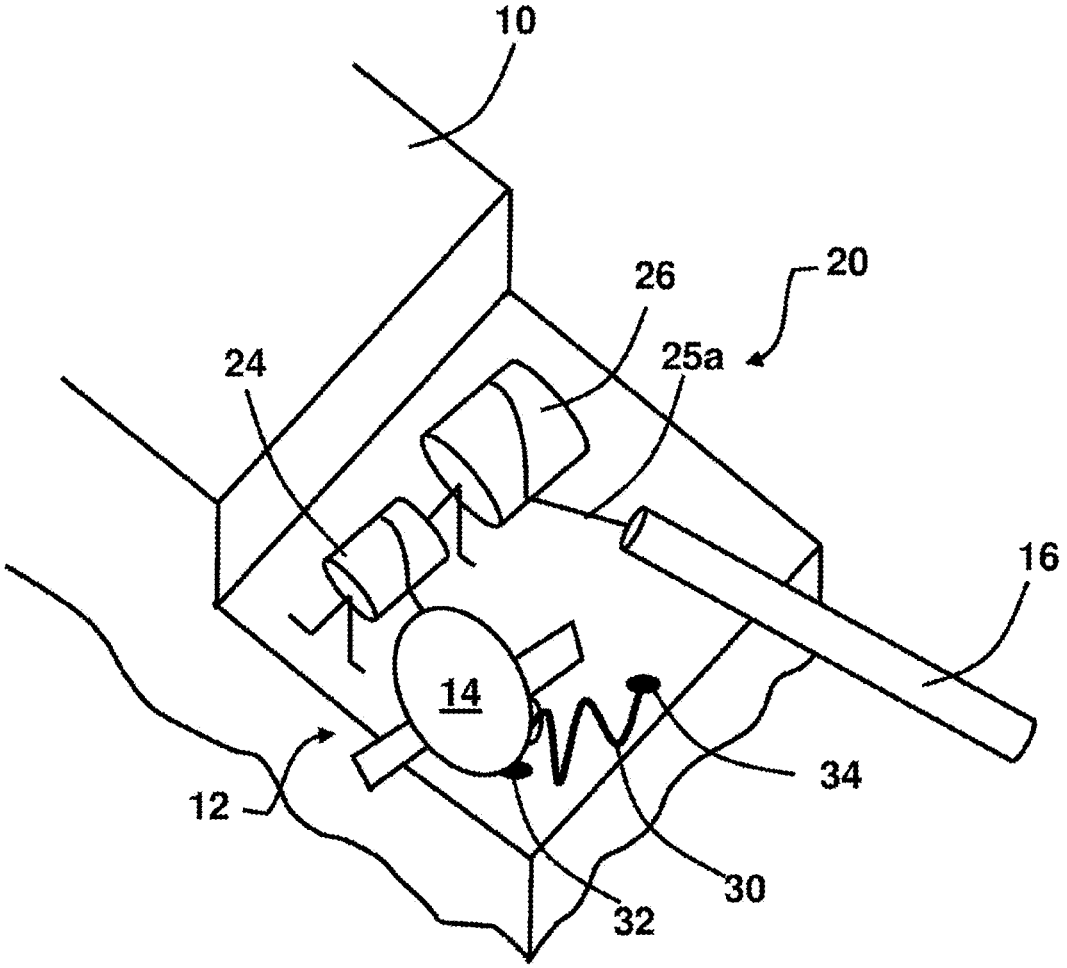
FIG. 1 schematically shows an underwater device in a first step of a method for launching it.

Thus, FIG. 1 shows a paying-out step for launching the streamer 16. In this step, the streamer 16 is coupled to the second winch 26 via a recovery cord 25*a*. The second winch 26 then revolves in a direction which allows the attachment cable 25 to be paid out so as to move the streamer 16 closer to the water without overshooting the stern. The intermediate element 30 is connected to the towfish 14. The intermediate element 30 is still not connected to the streamer 16.

In the step in FIG. 2, the intermediate element 30 is connected to the streamer 16 via the second end 34. Here, the intermediate element 30 is in an unaligned position with respect to the streamer 16. This step can be done at the base of the winch 26, which is to say in a less-exposed area in which the operator can face toward the sea. It is thus possible to anticipate any exceptional wave so as to take shelter.

Figure 3:
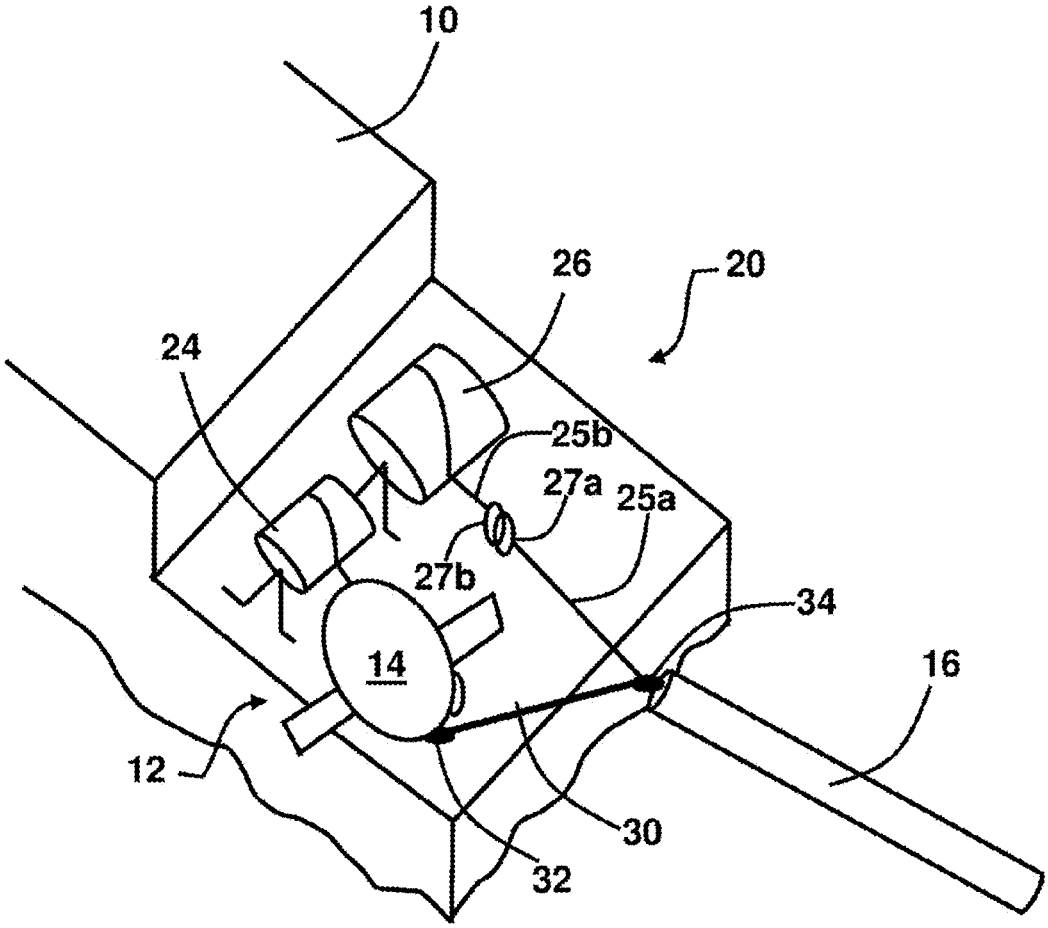
FIG. 3 shows the underwater device from FIG. 1 in a third step of the method for launching it.

In the step in FIG. 3, the recovery cord 25*a* is paid out and the streamer 16 continues its movement toward the water. The intermediate element 30 is thus progressively tensioned. The recovery cord 25*a* comprises a downstream shackle 27*a* which in this instance is connected to an attachment cable 25*b* via an upstream shackle 27*b*. The attachment cable 25*b* is paid out from the second winch 26.

Figure 4:
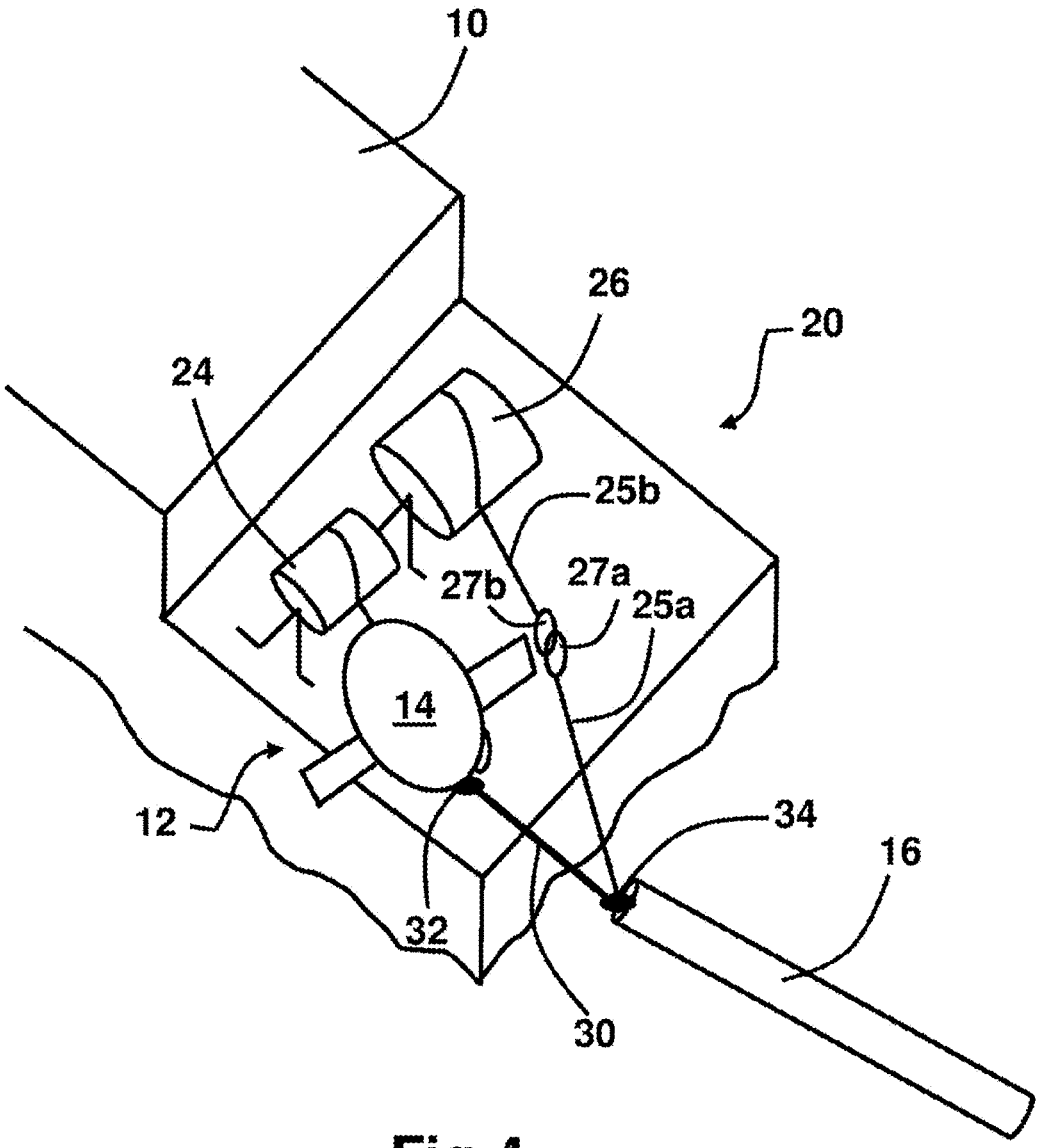
FIG. 4 shows the underwater device from FIG. 1 in a fourth step of the method for launching it.

In the step in FIG. 4, the attachment cable 25*b* has been paid out enough that the streamer 16 and the intermediate element 30 are aligned. In this position, the intermediate element 30 reaches a certain tension, referred to as towing tension.

In the step in FIG. 5, the attachment cable 25*b* continues to be paid out such that the tension generated by the mass of the streamer 16 is entirely reacted by the intermediate element 30. The recovery cord 25*a* then relaxes.

Figure 6:
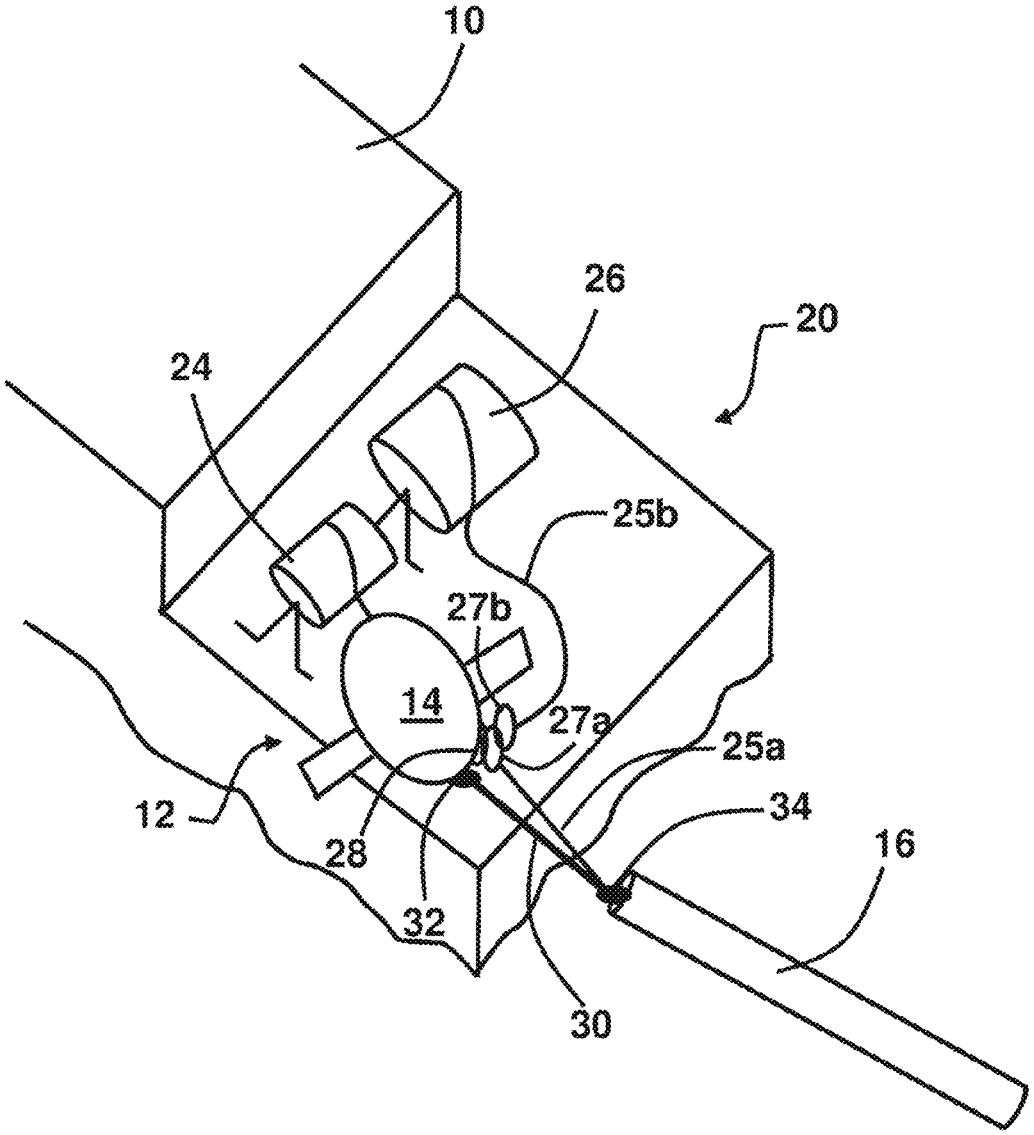
FIG. 6 shows the underwater device from FIG. 1 in a sixth step of the method for launching it.

In the step in FIG. 6, the downstream shackle 27*a* is attached to the towfish 14 via the coupling means 28. The upstream shackle 27*b* is then decoupled from the downstream shackle 27*a*.

Figure 7:
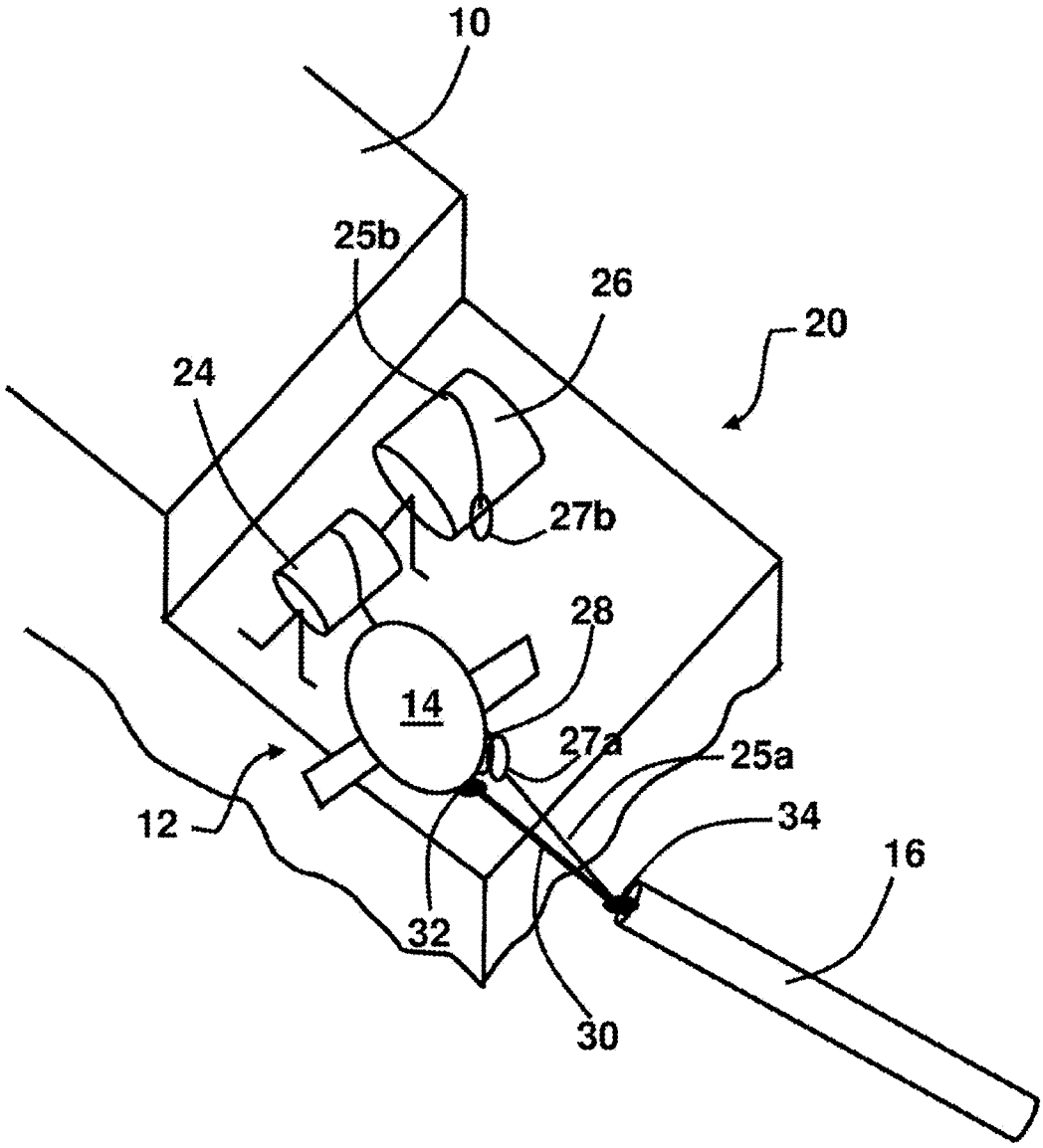
FIG. 7 shows the underwater device from FIG. 1 in a seventh step of the method for launching it.

In the step in FIG. 7, the attachment cable 25*b* is hauled in on the second winch 26 in order to free up the operator's working area. In a preferred embodiment, the upstream shackle 27*b* is detached from the attachment cable 25*b* to allow the attachment cable 25*b* to be completely hauled in.

Lastly, in the step in FIG. 8, the first winch 24 pays out the tow cable 18 allowing the entire sonar 12 to be launched. As already specified, during the operation of this sonar 12, the intermediate element 30 is aligned with the streamer 16 along the axis 36. The recovery cord 25*a* is fixed to the towfish 14 and to the streamer 16 and it then extends generally parallel to the intermediate element 30.

The sonar 12 is brought back up by reversing the order of the operations described above, which is to say: hauling in the tow cable 18 by means of the winch 24 to bring the towfish 14 onto the deck 22, attaching the upstream shackle 27*a* to the downstream shackle 27*a*, detaching the downstream shackle 27*a* from the towfish 14, tensioning the recovery cord 25*a* via the second winch 26 to move the intermediate element 30 from its position aligned with the streamer 16 to its unaligned position, detaching the second connection 34 to release the streamer 16.

The invention thus allows:

the underwater device 12 to be handled flexibly and more safely;

the connection position of the intermediate element to be shifted into an area less exposed for the operator;

compatibility with existing handling systems;

maintenance operations to be made easier, since the intermediate element 30 can act as a wearing part that is easier to change than the entire tow cable is.

The invention claimed is:

1. An underwater device intended to be towed by a surface ship, said surface ship being capable of comprising a handling system for stowing and deploying the underwater device, said handling system comprising a tow cable and an attachment cable, said underwater device comprising:

a flexible elongate body;

a towed body, said towed body being capable of being arranged between the tow cable and said flexible elongate body;

an intermediate element capable of being arranged between the towed body and the flexible elongate body, said intermediate element being connected to the towed body by a first connection, said intermediate element being connected to the flexible elongate body by a second connection, said first connection being an articulated mechanical connection, wherein said intermediate element is a low-stiffness cable and in that the underwater device comprises a recovery cord connected to the flexible elongate body, said recovery cord comprising a downstream shackle at an end opposite the flexible elongate body, said downstream shackle allowing the recovery cord to be fixed either to the tow cable via the towed body or to the attachment cable.

2. The underwater device as claimed in claim 1, wherein the attachment cable comprises an upstream shackle designed to be attached to the downstream shackle of the recovery cord.

3. The underwater device as claimed in claim 1, wherein the intermediate element is a light cable.

4. The underwater device as claimed in claim 1, wherein the intermediate element comprises an optoelectronic strand and a plurality of force reacting strands, said optoelectronic strand and said plurality of force reacting strands being separate.

5. The underwater device as claimed in claim 1, wherein the intermediate element is a reinforced cable.

6. The underwater device as claimed in claim 5, wherein the reinforced cable is reinforced by a tension braid.

7. The underwater device as claimed in claim 1, wherein the handling system comprises two winches, a first winch being capable of stowing and deploying the tow cable, a second winch being capable of stowing and deploying the attachment cable and wherein, in a first position, the intermediate element is aligned with the flexible elongate body to allow the first winch to tow the entire underwater device and wherein, in a second position, the intermediate element is unaligned with respect to the flexible elongate body to allow the flexible elongate body to be aligned with the second winch.

8. The underwater device as claimed in claim 1, wherein said underwater device comprises an electrical and/or optical link between the towed body and the flexible elongate body, and in that said electrical and/or optical link can be disconnected.

9. A method for launching an underwater device using a handling system which is part of a surface ship, said handling system comprising a tow cable and an attachment cable, said underwater device comprising:

a flexible elongate body;

a towed body, said towed body being capable of being arranged between the tow cable and said flexible elongate body during use of the underwater device;

an intermediate element capable of being arranged between the towed body and the flexible elongate body, said intermediate element being connected to the towed body by a first connection, said intermediate element being connected to the flexible elongate body by a second connection, said first connection being an articulated mechanical connection, said intermediate element being a low-stiffness cable and the underwater device comprising a recovery cord connected to the flexible elongate body, said recovery cord comprising, at an end opposite the flexible elongate body, a downstream shackle, said downstream shackle allowing the recovery cord to be fixed either to the tow cable via the towed body or to the attachment cable;

said handling system comprising two winches, a first winch for stowing and deploying the tow cable, a second winch for stowing and deploying the attachment cable and wherein, in a first position, the intermediate element is aligned with the flexible elongate body to allow the first winch to tow the entire underwater device, and wherein in a second position, the intermediate element is unaligned with respect to the flexible elongate body to allow said flexible elongate body to be aligned with the second winch, said launching method comprising:

a step of paying out the second winch to launch the flexible elongate body, the recovery cord being taut;

a step of connecting the flexible elongate body to the second end of the intermediate element in the unaligned position;

a step of positioning the intermediate element in alignment;

a step of paying out the second winch to slacken the recovery cord, the tension being reacted by the intermediate element;

a step of attaching the downstream shackle to the towed body and a step of detaching said downstream shackle from the attachment cable, so as to allow a subsequent recovery of a junction between the flexible elongate body and the intermediate element;

a step of paying out the first winch.

* * * * *